US005857508A

United States Patent [19]

Jonkka

[11] Patent Number: 5,857,508

[45] Date of Patent: Jan. 12, 1999

[54] METHOD OF FASTENING A WEAR PLATE AND A KNIFE BASE TO A DISC CHIPPER, AND A DISC CHIPPER

[75] Inventor: Arvo Jonkka, Pori, Finland

[73] Assignee: Sunds Defibrator Woodhandling OY, Pori, Finland

[21] Appl. No.: 894,026

[22] PCT Filed: Feb. 27, 1996

[86] PCT No.: PCT/FI96/00113

§ 371 Date: Aug. 11, 1997

§ 102(e) Date: Aug. 11, 1997

[87] PCT Pub. No.: WO96/26817

PCT Pub. Date: Sep. 6, 1996

[30] Foreign Application Priority Data

Feb. 27, 1995 [FI] Finland ..... 950885

[51] Int. Cl.[6] ..... B27C 1/00; B27C 7/10

[52] U.S. Cl. ..... 144/363; 144/176; 144/241; 241/92; 241/294

[58] Field of Search ..... 144/162.1, 172, 144/174, 176, 218, 230, 241, 363, 373; 241/92, 294

[56] References Cited

U.S. PATENT DOCUMENTS

| | | | |
|---|---|---|---|
| 3,981,337 | 9/1976 | Erik Wilhelm . | |
| 4,503,893 | 3/1985 | Dino M. Demopoulos . | |
| 4,669,516 | 6/1987 | Carpenter et al. | 144/176 |
| 5,287,901 | 2/1994 | Mathews | 144/176 |
| 5,469,902 | 11/1995 | Sharp et al. | 144/176 |

FOREIGN PATENT DOCUMENTS

| | | |
|---|---|---|
| 33 15 316 C2 | 3/1992 | Germany . |
| 405 081 | 11/1978 | Sweden . |
| WO 90/15702 | 12/1990 | WIPO . |

*Primary Examiner*—W. Donald Bray
*Attorney, Agent, or Firm*—Burns, Doane, Swecker & Mathis, L.L.P.

[57] ABSTRACT

A method for mounting a wear plate and a knife base on a disc chipper's disc, and a disc chipper. The wear plate (6) rests against the knife base (4) via two counter surfaces (12), one of which forms in the wear plate (6) a groove in parallel to the knife (3) and the other forms in the knife base (4) a ridge which can be fitted into this groove. The tightening force of the fastening bolts (17, 18) of the wear plate (6) presses the knife base (4) against the disc (1) by means of the wear plate via these counter surfaces (12).

16 Claims, 5 Drawing Sheets

METHOD OF FASTENING A WEAR PLATE AND A KNIFE BASE TO A DISC CHIPPER, AND A DISC CHIPPER

This invention relates to a method in accordance with the preamble of claim 1 of mounting a wear plate and a knife base on a disc chipper's disc, and to a disc chipper in accordance with the preamble of claim 3.

For producing chips for use in pulp production a chipper is generally used, wherein knives chipping the log of wood against a fixed counter knife are mounted onto a knife disc approximately in a radial direction. Wear plates against which the log of wood is fed are located in sectors between the knives. The distance between the wear plate and the counter knife increases from one knife to the following knife. Chip length depends on the so-called T dimension, that is, the distance between the wear plate and the cutting edge of the following knife, measured in parallel with the knife disc shaft.

Chip length as such is not the most important characteristic in pulp production, but chip thickness is. Longer chips are always also thicker when produced in similar conditions. Other factors besides length which affect chip thickness are the quality of logs of wood, feeding and knife angles of the chipper, and the cutting speed of the knife. Tests indicate that a higher speed gives thinner chins, given a constant chip length. In a disc chipper, the cutting speed is higher at the outer disc rim than closer to the shaft. For this reason, when for example the chip length is increased to obtain thicker chips, the length ought to be increased more at the outer rim of the knife disc, because due to the higher speed, the same change of length there will not result in an equal change of thickness as nearer to the shaft where the speed is lower.

Because the same chipper is used for chipping different kinds of wood in different seasons and, in addition, chips from the same chipper are used for different pulps, it must be possible to perform adjustment of the chip length and at the same time of the thickness promptly and with small costs.

One method of chip length adjustment in a disc chipper is described in patent publication FI 79799. In the method according to patent publication 79799, however, mounting of the knives against the wear plate by pressing by means of screws and a knife stop causes bending of the wear plate, so that the distance between the cutting edge of the knife and the counter knife will change. The distance between the knife edge and the counter knife will also change when adjusting the chip length by turning the wear plate around its pivot joint, so that the whole knife disc must be moved. Because the entire wear plate and the knife along with it will turn during adjustment, the knife cutting angles will change at the same time, so that the clearance angle is smaller with short chips. "Suction" into the chipper is also reduced as a result of this. In addition, changing of knives is difficult, because the knives are exchanged from the other side of the chipper disc than where the screws are opened and tightened.

Another known adjustable wear plate system is a structure in accordance with printed application WO90/15702, wherein a knife cassette is mounted on a knife disc by means of spacers and the adjustment of the chip length is done by a torsioning wear plate. The publication also describes an embodiment wherein fastening bolts at the front edge of the wear plate are supported against the disc by means of semispherical washers. The weak point in this system is its complicated structure and numerous dust-producing recesses for bolt heads in the wear plate.

The disadvantages of known adjustable wear plate systems are eliminated by the present invention. The method according to the invention is characterized in that the wear plate rests against the knife base via two counter faces, of which one forms in the wear plate or in a strip supported against the wear plate a groove in parallel or almost in parallel with the knife, while the other forms in the knife base a ridge which can be fitted into this groove, and in that the tightening force of the wear plate's fastening bolts by means of the wear plate presses the knife base against the disc via these counter surfaces.

The disc chipper according to the invention is characterized in that the wear plate or a strip supported against it and the knife base have counter surfaces which may be fitted opposite to one another and of which one forms a groove in the wear plate or in the strip supported against it, in parallel or almost in parallel to the knife, while the other forms a ridge in the knife base which may be fitted into this groove, and in that the wear plate presses the knife base against the disc through these counter surfaces.

The invention and its details are described more closely in the following, referring to the enclosed drawings, wherein FIG. 1 shows one quarter of a disc in a chipper according to the invention seen, from the cutting plane side;

Figure 1:
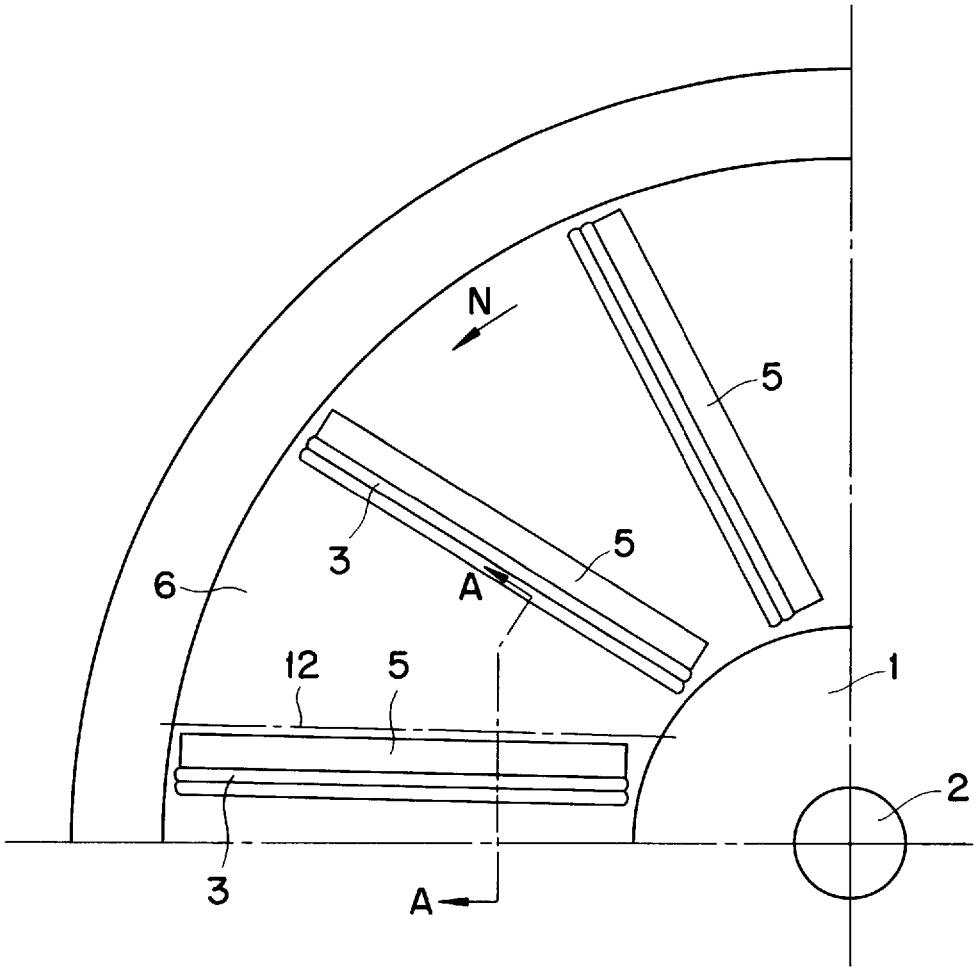
Figure 3:
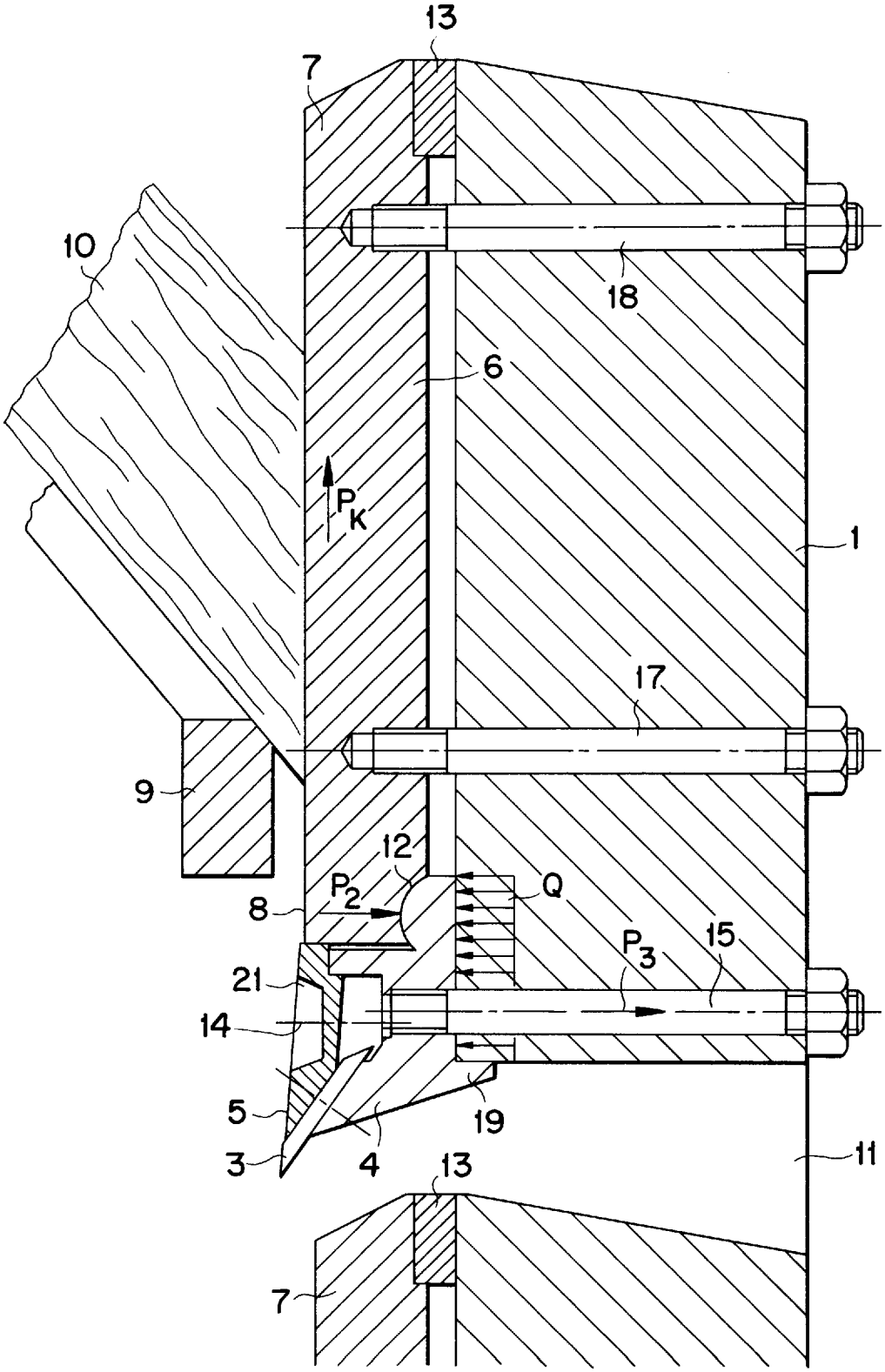
FIG. 3 is a cross-section A—A of FIG. 1 in a bigger scale, also showing the log of wood being fed and a counter knife.

The body 1 of the chipper's knife disc is mounted on a rotating shaft 2. Arrow N shows the disc's direction of rotation in FIG. 1. Several knives 3 are mounted on the disc and extend from the central part of the disc towards the outer periphery of the disc. The knives have straight cutting edge lines all in the same plane perpendicular to the disc shaft 2. The direction of the knives may differ from the radial direction so that the outer end of the knife will move foremost or rearmost as the disc is rotating. The knives are mounted on knife bases 4 by means of knife presses 5 and fastening screws 14 (FIG. 3). The knife bases 4 are mounted on the knife disc 1 with bolts 15. The main part of the sectors between the knives are covered by inclined wear plates 6, which are mounted on the knife disc with bolts 17 and 18. Under the tightening force of the bolts 17 and 18, the wear plate 6 presses the knife base 4 in the direction of force $P_2$ against the knife disc via a pivoting hinge joint 12. Under forces $P_2$ and $P_3$, a force pattern according to Q is applied from the knife disc to the knife base 4, and the mounting of the knife base is very steady. Because the tightening force of the bolts 17 and 18 is used for mounting both the knife base and the wear plate, the number of holes required in the knife disc is small.

The knife base mounting in accordance with the invention is suitable when it is desired to have a possibility to use also an alternative knife system, whereby the line of holes for bolts 15 is near the chip openings 11. This is also the case when it is desired to use a new type of knife system with traditional chippers.

The direction of the outer surface of the wear plate differs from the plane formed by the cutting edge lines of the knives so that the sector edge 7 moving behind is at a longer distance from the knife plane than the edge 8 moving ahead. The distance between the rear edge 7 and the following knife edge in parallel with the shaft of the knife disc is the T dimension shown in FIG. 2 which determines the chip length when the log of wood 10 is pushed against the wear plate 6.

The log of wood moves in a longitudinal direction towards the disc and is pressed against the counter knife 9, and the knife cuts chips from the log of wood in direction oblique to its grain. Chips exit by way of the knife openings 11 in the disc.

Figure 2:
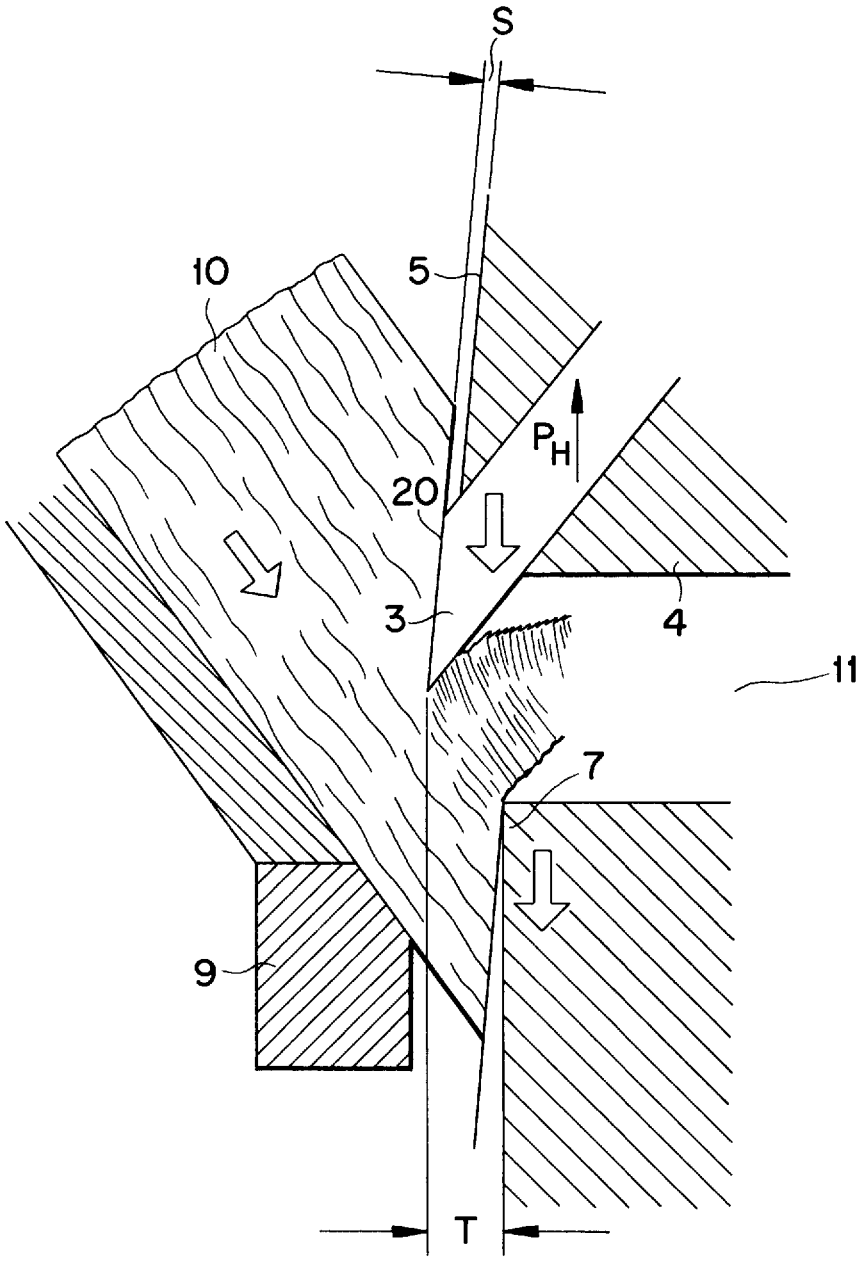
FIG. 2 illustrates the wood cutting process in a chipper, also showing the counter knife and the end of the log of wood being fed.

As the counter knife prevents the log of wood from moving in a radial direction, a force in direction $P_H$ is applied from the log of wood 10 to the knife 3 and via the knife press 5 to the knife base 4 (FIG. 2). A force on the wear plate 6 in direction $P_H$ is also caused by a friction force $P_K$ of the logs of wood as they contact the wear plate surface in the area between the knives (FIG. 3). The forces $P_H$ and $P_K$ applied to the knife equipment during chipping tend to move the knife equipment in the direction of the force $P_H$. This is prevented by means of a shoulder 19 in the knife base and the friction force between the knife base and the knife disc. Movement of the wear plate 6 due to the force $P_K$ is prevented by means of the pivoting hinge joint 12 and the force $P_2$.

In generally known chippers, the front face 20 of the knife is located further out than the front edge of the wear plate or the knife press 5, so that a gap S is formed between the log of wood and the front edge of the wear plate (FIG. 2). In a disc chipper according to the invention, the log of wood to be chipped does not touch the knife press 5, after the knife 3 it does not reach the knife disc until in the wear plate area. Thus, the log of wood to be chipped will not chafe against the rear edges 21 of the bolt recesses in the knife press 5 (FIG. 3). Because the log of wood, however, touches the wear plate, it is advantageous that there are no such recesses in the surface of the wear plate 6 which would work off dust from the log of wood.

FIG. 3 shows an arrangement for the adjustment of the wear plate's position. The pivoting surfaces of the knife base 4 and the wear plate 6 in contact with each other are shaped as parts of a cylinder surface, one convex and the other concave. The cylinder surface axis is in parallel or almost in parallel to the cutting edge line of the knife. The wear plate is allowed to turn in relation to the knife base 4 around the axis of the pivoting surface 12. By means of this turning motion, it is possible to adjust the position of the outer surface of the wear plate 6 and the distance of the plate's rear edge 7 from the front edge 8 of the following wear plate.

An adjusting strip 13 is located in a groove in the wear plate between the rear edge 7 of the wear plate and the disc body 1. Its distance from the pivoting surfaces 12 is longer at the outer rim of the knife disc than at the inner rim.

By exchanging adjusting strips 13 of different thicknesses it is possible to adjust the inclination of the wear plate and thus the chip length. Because the distance between the adjusting strip 13 and the pivoting surfaces 12 is longer at the end of the outer periphery of the disc than in the central part of the disc, the turning motion of the plate 6 is longer at the outer rim of the disc. By increasing the chip length more at the disc's outer rim than in its centre, thinning of the chips due to the higher peripheral speed of the outer rim is compensated for. Chip length may also be adjusted by using a four- or six-side strip, the sides of which have two or three different widths, the opposite sides being of equal width. By turning this kind of a strip, two or three different chip lengths are obtained.

Figure 4:
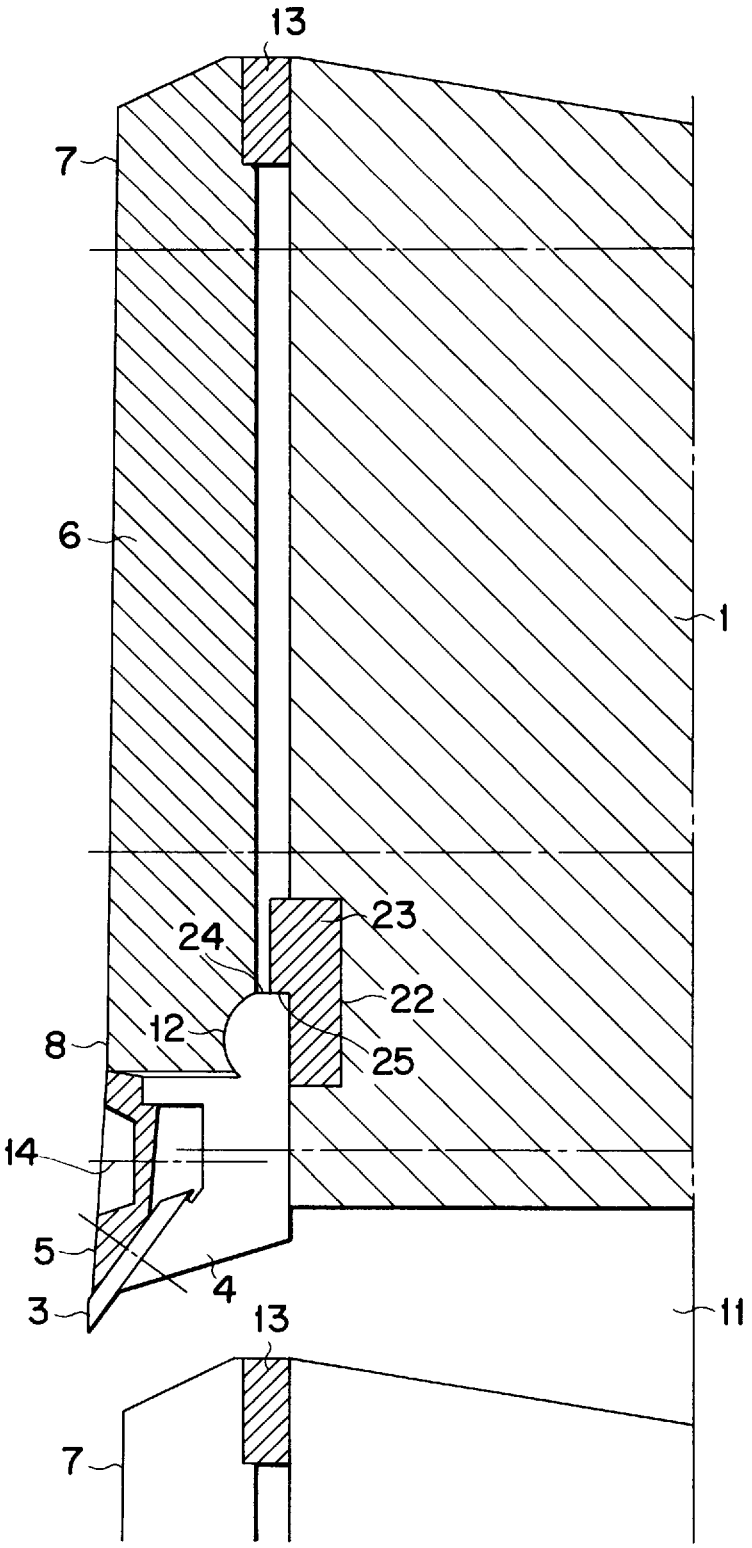
FIGS. 4 and 5 show alternative embodiments.

FIG. 4 shows an embodiment of knife equipment supported with a spacer 23 in a locking groove 22 in a knife disc 1 of old chippers in use, wherein the knife base 4 is supported by means of a surface 24 in the locking groove 22 in the disc 1 via a protrusion 25 in the spacer 23.

Figure 5:
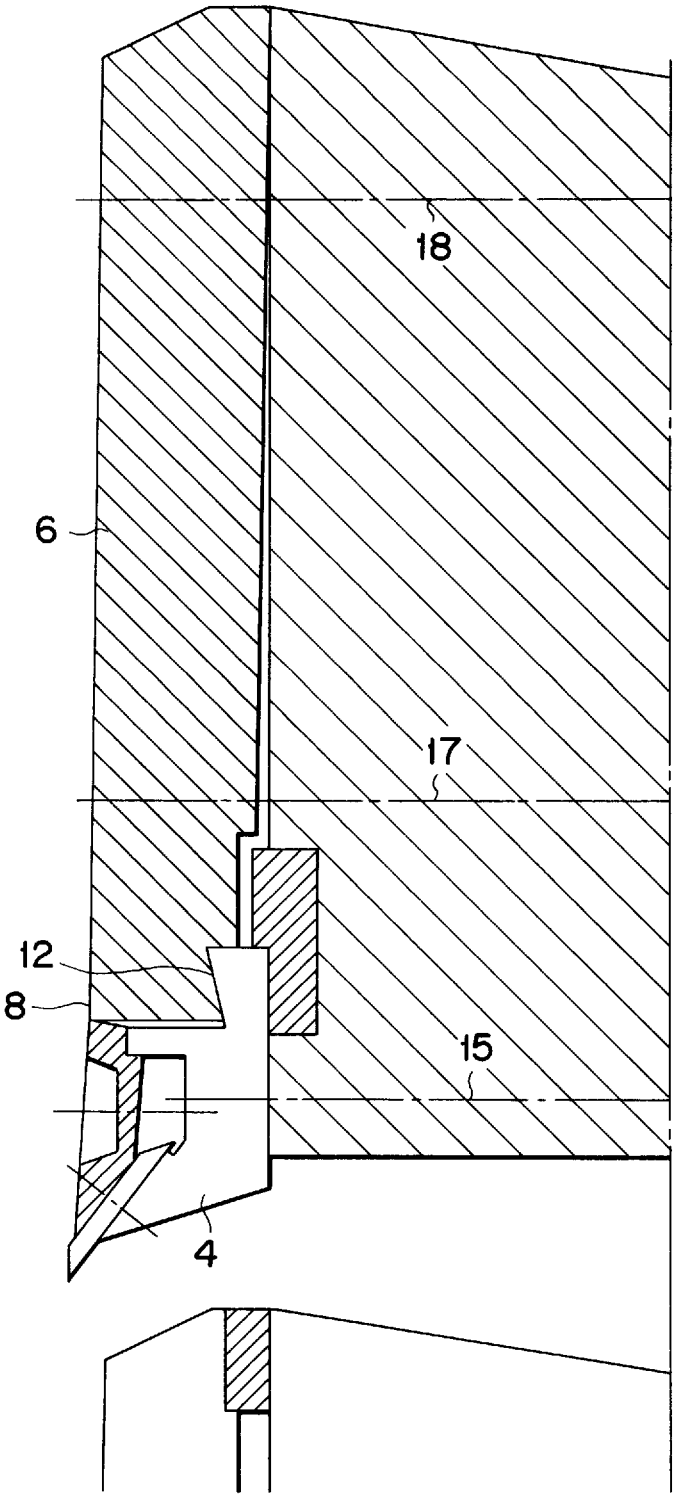

The invention may also be used in chippers not requiring any chip length adjustment. The cylinder surfaces may then be exchanged for inclined planes. Such an embodiment is shown in FIG. 5. In the wear plate side edge of the knife base 4 there is a counter surface 12, forming an acute angle with the side surface of the wear plate edge 8 which is moving foremost. When the fastening screws 17 and 18 of the wear plate are tightened, the wear plate presses the corresponding counter surface of the knife base through a wedge-like and chamfered stop surface 12 and makes sure that the knife base will remain in its place. The adjusting strip 13 may then even be omitted, so that the rear edge 7 of the wear plate will rest against the knife disc surface.

The invention is not restricted only to the embodiments presented in the foregoing, it may vary in different ways within the scope of the claims. Naturally, the cylinder surfaces 12 may be the other way round so that the convex surface is in the wear plate and the concave surface is in the knife base. Cylinder surfaces may be formed not only in the wear plate itself but also in a separate strip leaning against this. The structure according to the invention may also be formed with a hinge shaft having two convex surfaces. Both the wear plate and the knife base then have concave surfaces. However, the intention of the structures shown in the drawings is that as few parts as possible are used and that the fastening screws of the wear plate will also support the knife base.

In the foregoing, chip length means a dimension in the wood grain direction, which is determined according to the T dimension and knife angles. Chip thickness is the dimension perpendicular to the length which is determined as the chip breaks between the wood grain.

I claim:

1. A disc chipper comprising:

a plurality of knives;

a rotatable disc on which the plurality of knives are mounted;

a plurality of knife bases, a knife base of the plurality of knife bases being disposed under each knife of the plurality of knives;

a wear plate arrangement disposed in sectors between the plurality of knives bolts for mounting the wear plate arrangement and the knife bases to the disc, the bolts extending into threaded openings in the knife bases and the wear plate arrangement and not extending through a front surface of the wear plate;

the wear plate arrangement including counter surfaces in the form of grooves substantially parallel to corresponding ones of the plurality of knives, and each knife base including a counter surface in the form of a ridge for being received in a corresponding groove counter surface of the groove counter surfaces, the plurality of knife bases having a plurality of ridge counter surfaces;

wherein, when the bolts are tightened, the wear plate presses the knife bases against the disc via the groove counter surfaces and the ridge counter surfaces.

2. A disc chipper as defined in claim 1, wherein at least part of each groove counter surface of the groove counter surfaces forms an acute angle with a side surface of a foremost edge of the wear plate.

3. A disc chipper as defined in claim 1, wherein each ridge counter surface is convex and forms part of a cylinder surface and each corresponding groove counter surface is concave and forms part of the cylinder surface corresponding to the ridge counter surface, the wear plate arrangement being movable relative to the disc about a central axis of the cylinder surface as the axis of rotation and lockable relative to the disc in a pluralitv of positions.

4. A disc chipper as defined in claim 1, a rearmost edge of the wear plate arrangement is supported against a removable adjusting strip adapted to be changed to adjust a distance of the rearmost edge to change the chip length.

5. A disc chipper as defined in claim 1, wherein the ridge counter surfaces and the groove counter surfaces are planar.

6. A disc chipper as defined in claim 1, wherein the knife base forms a mounting part for fastening screws of a knife press.

7. A disc chipper as defined in claim 4, wherein the knife base forms a pivoting joint surface on a rear side of the wear plate arrangement (13) is exchanged or turned around to adjust the chip length.

8. A disc chipper as defined in claim 1, a foremost edge of each knife base has a shoulder, the shoulder being supported against the disc at an edge of a chip opening.

9. A disc chipper as defined in claim 1, wherein a rearmost edge of each knife base is supported against a protruding member of the disc.

10. A disc chipper as defined in claim 2, wherein the ridge counter surface is convex and forms part of a cylinder surface and the groove counter surface is concave and forms part of the cylinder surface corresponding to the ridge counter surface, the wear plate arrangement being movable relative to the disc about a central axis of the cylinder surface as the axis of rotation and lockable relative to the disc in a plurality of positions.

11. A disc chipper as defined in claim 2, wherein the ridge counter surfaces and the groove counter surfaces are planar.

12. A disc chipper as defined in claim 2, wherein the knife base forms a mounting part for fastening screws of a knife press.

13. A disc chipper as defined in claim 2, a foremost edge of each knife base has a shoulder, the shoulder being supported against the disc at an edge of a chip opening.

14. A disc chipper as defined in claim 2, wherein a rearmost edge of each knife base is supported against a protruding member of the disc.

15. A method for mounting a wear plate and a knife base on a disc chipper disc, comprising the steps of:

arranging a groove counter surface of a wear plate relative to a corresponding ridge counter surface of a knife base such that the ridge counter surface is received in the groove counter surface;

fastening the wear plate and the knife based to a disc chipper disc with bolts extending through the disc and into a rear surface but not to a front surface of the wear plate such that the groove counter surface is caused to press against the ridge counter surface.

16. The method according to claim 15, comprising the further steps of supporting the wear plate in a direction of rotation against the knife base, and supporting the knife base against an edge of a chip opening by a supporting structure disposed proximate the chip opening.

* * * * *